US006484645B2

(12) United States Patent
Allen

(10) Patent No.: US 6,484,645 B2
(45) **Date of Patent: *Nov. 26, 2002**

(54) PIVOTAL SUPPORT AND FOLDAWAY WINGS

(75) Inventor: Garry William Allen, Nerang (AU)

(73) Assignee: Intellec Pty Limited, Nerang (AU)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/011,294

(22) PCT Filed: Jul. 15, 1996

(86) PCT No.: PCT/AU96/00443

§ 371 (c)(1),
(2), (4) Date: Oct. 20, 1998

(87) PCT Pub. No.: WO97/04159

PCT Pub. Date: Feb. 6, 1997

(65) Prior Publication Data

US 2001/0052309 A1 Dec. 20, 2001

(30) Foreign Application Priority Data

Jul. 14, 1995 (AU) ..... PN4147

(51) Int. Cl.[7] ..... A47B 3/00
(52) U.S. Cl. ..... 108/33; 108/38
(58) Field of Search ..... 108/33, 38, 42, 108/34, 39, 40; 312/313, 316, 311; 248/235, 240.1, 250

(56) References Cited

U.S. PATENT DOCUMENTS

| | | | | | |
|---|---|---|---|---|---|
| 2,473,022 | A | * | 6/1949 | Fenske, Jr. | 108/38 X |
| 2,567,538 | A | * | 9/1951 | Anderson | 312/313 X |
| 2,680,314 | A | * | 6/1954 | Snyder | 108/39 |
| 3,300,791 | A | * | 1/1967 | Carmack | 108/39 X |
| 4,480,556 | A | | 11/1984 | Wilson et al. | |
| 4,686,355 | A | * | 8/1987 | Lay | 108/33 X |
| 4,961,388 | A | | 10/1990 | Simpson | |
| 5,255,724 | A | * | 10/1993 | Butke | 108/33 X |
| 5,369,898 | A | | 12/1994 | Sorensen | |
| 5,452,531 | A | * | 9/1995 | Graville et al. | 108/39 X |
| 5,479,865 | A | * | 1/1996 | Cauffiel | 108/42 |
| 5,622,119 | A | * | 4/1997 | Hsieh | 108/38 X |
| 5,709,155 | A | * | 1/1998 | Terracciano | 108/42 |

FOREIGN PATENT DOCUMENTS

| | | |
|---|---|---|
| AU | 18523/88 | 1/1989 |
| EP | 278 796 | 8/1988 |
| GB | 853043 | 11/1960 |
| GB | 2271360 | 4/1994 |
| WO | 83/00990 | 3/1983 |

* cited by examiner

*Primary Examiner*—Jose V. Chen
(74) *Attorney, Agent, or Firm*—Merchant & Gould, P.C.

(57) ABSTRACT

A hinge for wings such as ironing board supports the board off a support (3) on pairs of link (2, 3) which engage (29, 30) to limit angular movement beyond a working disposition. The board (24) may be folded and collapsed into a wall mounted cover (28). The wall mounted unit might be fitted to a height adjustment mechanism (118). The links (2, 3) may be combined with a means (63) increasing the angular extent of the folding action to collapse the folded board (80) into a drawer unit (84). The board may be mounted to a turntable (101) to allow for angular movement. The board (24) may be supported on supports (35) attached to sliding tracks (34) to enable movement to a storage position in a cabinet (32).

15 Claims, 9 Drawing Sheets

PIVOTAL SUPPORT AND FOLDAWAY WINGS

TECHNICAL FIELD

THIS INVENTION relates to a hinge mechanism applicable to angularly movable wings such as a foldaway ironing board assembly and to assemblies employing the hinge mechanism such as a foldaway ironing board assembly mounted to a support structure such as a wall, kitchen unit, cupboard bench support, mobile cabinet or drawer.

BACKGROUND ART

Many different mechanisms are employed in establishing items such as foldaway ironing board assemblies which save space and offer advantages over more conventional portable ironing boards which are supported from the ground by scissor action legs. These conventional portable ironing boards are not always easy to erect and stow and they are therefore considered inconvenient. In contrast foldaway ironing board assemblies mounted to a support structure are usually more convenient than portable ironing boards. They can be easier to move from a stored position to an operative position depending on the nature of the mechanism by which they are mounted.

When in a stored position the above foldaway ironing board assemblies are located against, for example, a wall in which the longitudinal axis of the board is positioned vertically. When moved between the stored and an operative position the longitudinal axis pivots about a vertical axis and therefore the length of the ironing board protrudes out into a room. This therefore limits the type of room such foldaway ironing boards can be practically used in. Furthermore, the protruding tapered end of the ironing board is substantially unsupported and excessive pressure on this end may damage supporting struts extending from the wall to the underside of the ironing board.

U.S. Pat. No. 5,369,898 (Sorensen) is a wall mounted board, pivoted down from a vertical storage position to a working disposition whereat the board rests on a bracket acting against further downward angular movement.

GB 2271360 (Burke) is a similar board to that of Sorensen above, mounted inside a cabinet with a height adjustment. These styles are hinged at their end and extend outwardly perpendicularly from the wall behind them.

U.S. Pat. No. 4,961,388 (Simpson) provides its board on a mechanism which pivots and rotates out of its storage position.

U.S. Pat. No. 4,480,556 (Wilson et al) provides its board with a mechanism for swivelling the board between two horizontal positions at different heights on a turntable mounting locked by a ratchet.

OBJECTS OF THE INVENTION

It is an object of the present invention to provide a mechanism for pivoting a member which mechanism shifts the centre of angular movement of the member off the support to the member enabling more compact structures.

It is a further object of the invention to enable the pivoting of wings out of storage compartments which are more compact than has hitherto for been possible.

It is a still further object of the invention to provide an ironing board able to be folded out of a compact storage space into a working disposition.

DISCLOSURE OF THE INVENTION

The invention achieves its object in the provision of a mounting assembly for a member by which the member is angularly movable from a storage position to a working position comprising:

a first link adapted for pivotal mounting to a support at a first end and said member at a second end;

a second link adapted for pivotal mounting to the support at a first end and at a point thereat below the connection point of the first link and said member at a second end;

said second link being abutted, in use, at the working position of the member against a stop means or limit means on said first link to prevent angular movement of the member past the working position.

In a particular variation of the mounting assembly it is associated with an intermediate pivotal plate interconnected with the links and the member via a slotted plate introducing an extra degree of relative angular movement of the member.

Advantageously two of the above defined mounting assemblies are used to mount on angularly movable wing to a supporting surface enabling the wing to move between a storage and working position. The wing may support an angularly movable planar element thereover providing a working surface at the working position. Ideally the planar element might be in two hinged parts able to be folded together to reduce their area in a storage means.

Ideally the above described angularly movable wing is an ironing board. The board may be stored vertically and lowered angularly to a horizontal disposition. The board may be stored vertically on the side of a linearly translatable frame, being raised thereover to its working position. The board may be stored collapsed into a flat pack in a drawer unit, able to be drawn therefrom and extended horizontally outwardly. By these means the board may be mounted into a wall cabinet, which can be vertically adjustable; a cupboard from which the board can be drawn and then rotated upwardly; or located in a drawer unit of a cabinet, cupboard, or the like.

BRIEF DESCRIPTION OF THE DRAWINGS

In order that the invention may be readily understood and put into practical effect, references will now be made to preferred embodiments shown in the accompanying drawings in which.

PREFERRED EMBODIMENTS

Figure 1:
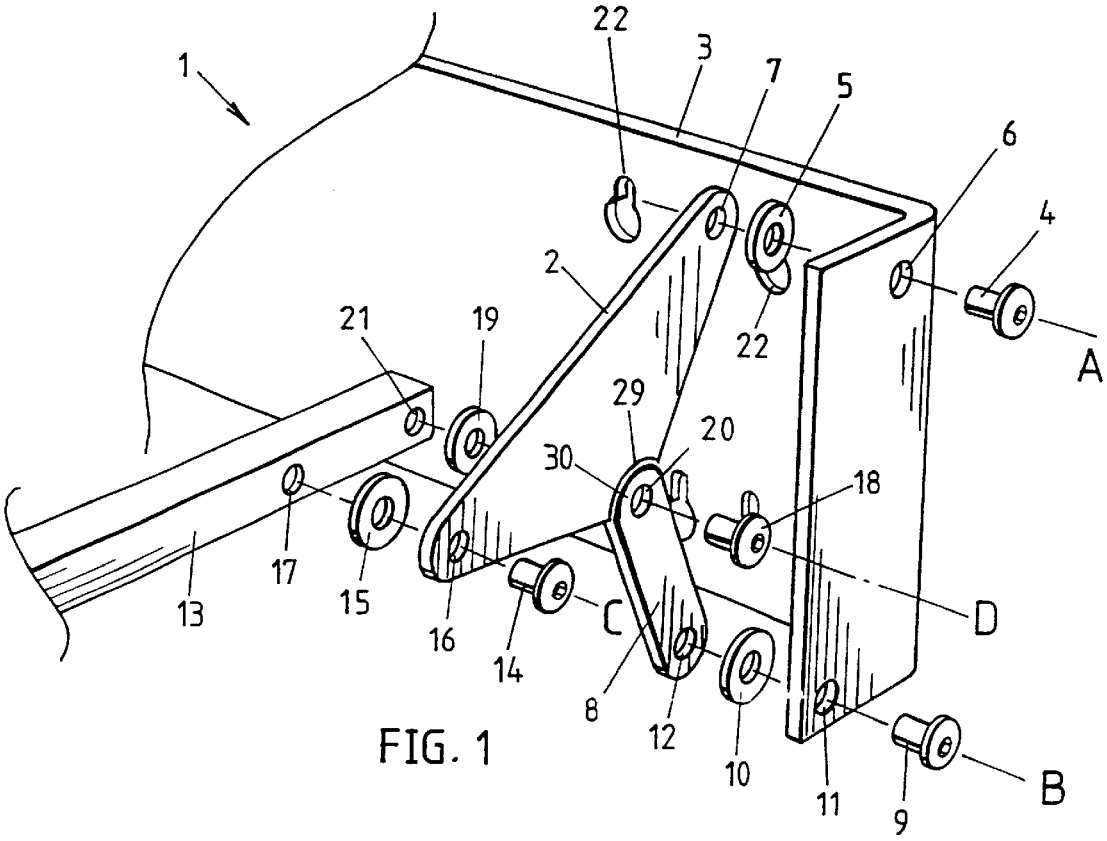
FIG. 1 is an exploded perspective view of a support means.
Figure 2:
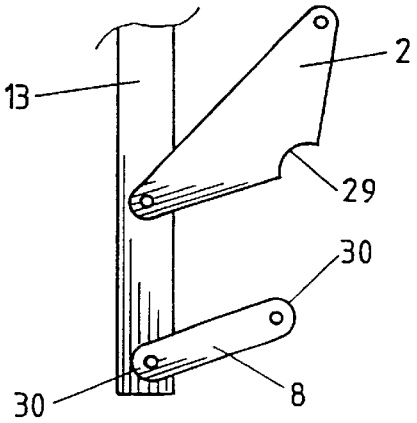
FIG. 2 is a side view of the support means of FIG. 1 when in a stored position.

Referring to FIGS. 1 and 2, there is illustrated a mounting assembly or cantilevered support means 1 having a first link or support member 2, second link or support member 8, and movable member or support 13.

First link or support member 2 can be pivotally mounted to an upright support structure in the form of a mounting plate 3, pivoted about a first horizontal axis A. A pivot pin 4 can be inserted through apertures 6,7 and washer 5 to provide the pivotal mounting of the first link at a first end thereof about horizontal axis A.

Second link or support member 8 can be pivotally mounted to plate 3 about a second horizontal axis B. A pivot pin 9 can be inserted through apertures 11, 12 and washer 10 to provide the pivotal mounting of the second link at a first end thereof about horizontal axis B.

Angularly movable member 13 can be pivotally mounted to first support member 2 at a second end thereof about a third horizontal axis C. Again a pivot pin 14 can be inserted through apertures 16, 17 and a washer 15 can provide a pivotal mounting about horizontal axis C. Member 13 can be pivotally mounted to second support member 8 at a second end thereof about a horizontal axis D by a pivot pin 18 inserted through apertures 20, 21 and washer 19.

When pins 4, 9, 14 and 18 have been inserted as described above they may be fixed against being removed by their inserted ends being peened by any known method.

First support member 2 may have a heel portion as shown which can provide a female engagement means or concavity 29 which can be engageable with an end of second support member 8 which provides a complementary male engagement means or convex end 30.

Plate 3 may be provided with slotted apertures 22 for mounting to a wall or other support structure. When disposed as in FIG. 1 the member 13 is in an operative or working position in which the lock, limit, stop or engagement means 29 and 30 may engage with each other. FIG. 2 illustrates the disposition of the support member 2 when in a stored position in which engagement means 29 and 30 are disengaged.

Referring to FIGS. 3 to 6 there is illustrated a foldaway ironing board assembly 23 which is supported from an upright support structure such as a wall to which plate 3 is mounted by screws passing through slotted apertures 22. Foldaway ironing board assembly 23 can include an elongate ironing board member 24, mounted to a generally U-shaped bent tubular bar whose arms can provide two spaced apart angularly movable members 13 of two support means 1 each of which can be mounted to opposite ends of plate 3 as described above. Ironing board member 24 preferably includes a frame 25 and a planar ironing surface, ideally formed from an expanded metal grid 26. Ironing board member 24 is ideally foldable about at least one transverse axis T1 and preferably a cushioned cover 27 may cover grid 26. A storage cover 28 can also be provided and is preferably pivotally mounted to one end of parallel arms 31, the other end of arms 31 being pivotally mounted to plate 3.

Figure 3:
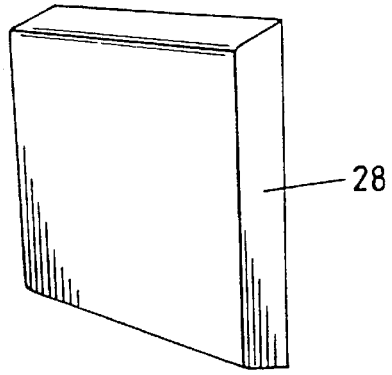
FIGS. 3 to 6 are perspective views of a foldaway ironing board assembly including the support means of FIGS. 1 and 2.
Figure 4:
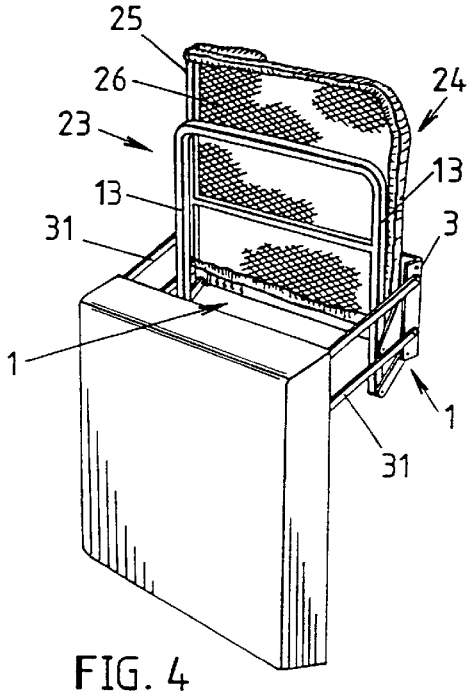
Figure 5:
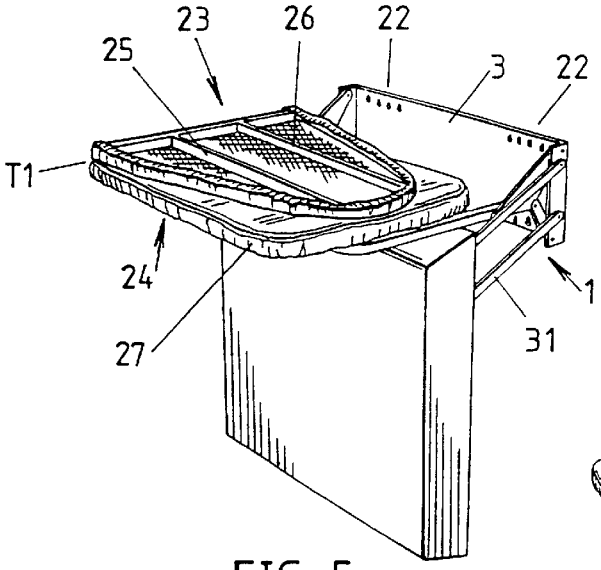
Figure 6:
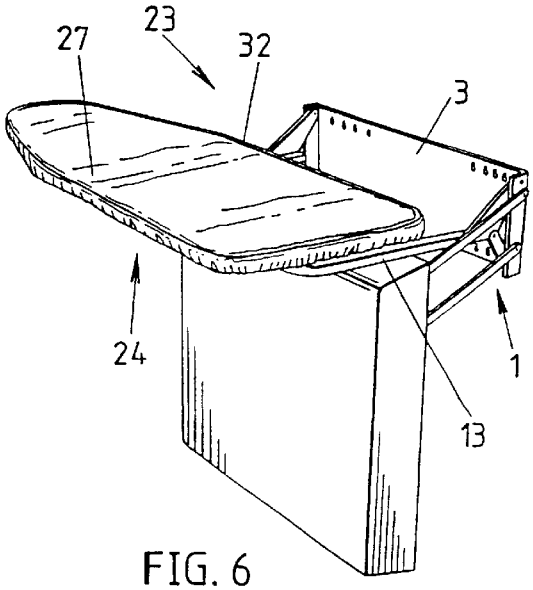

When in a stored position, shown in FIG. 3, foldaway ironing board assembly 23 is covered by storage cover 28 which may have a magnetic catch (not shown). When foldaway ironing board assembly 23 is desired to be used, storage cover 28 is moved to the position as shown in FIGS. 4 to 6. Ironing board member 23 is then pulled down from a vertical stored position shown in FIG. 4 to a horizontal position as shown in FIG. 5. In this regard both support means 1 move from the position as shown in FIG. 2 to the position shown in FIG. 1 and thereby engagement means 29 and 30 become engaged thereby restraining movement of support means 1. Ironing board member 24 may then be unfolded about pivotal axis T1 to an operative position in which a longitudinal edge 32 is in close proximity to plate 3 and a portion of support means 1 extends between longitudinal edge 32 and the plate 3. When ironing board assembly 23 is no longer required to be used it can be stored by a reverse operation to that as described above.

Referring to FIGS. 7 to 10 there is illustrated a second embodiment of a foldaway ironing board assembly 32. To avoid repetition the only differences between the above first embodiment will be described.

A retractable cantilevered support means 34 can include support members 2,8 and plate 35 preferably mounted at unsupported ends of two telescopic arms 36 slidably mounted to respective runners 37 ideally located inside a support structure, which in this embodiment is an upright wall 39 of a storage area under a bench top 38. A further plate 35 can be mounted intermediate the ends of arms 36 and they are preferably pivotally mounted to each plate 35 on pairs of links or support members 2, 8. Member 40 of support means 34 is pivotally mounted to links 2,8. Also ideally mounted to the outermost angularly movable support member 40 is a threaded locking pin 41 for releasable engagement with a threaded aperture 42 on outer plate 35.

Figure 7:
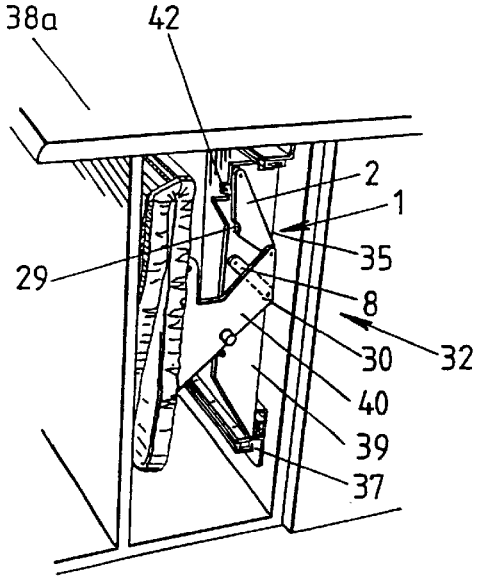
FIGS. 7 to 10 are perspective views of a second preferred embodiment of the invention.
Figure 8:
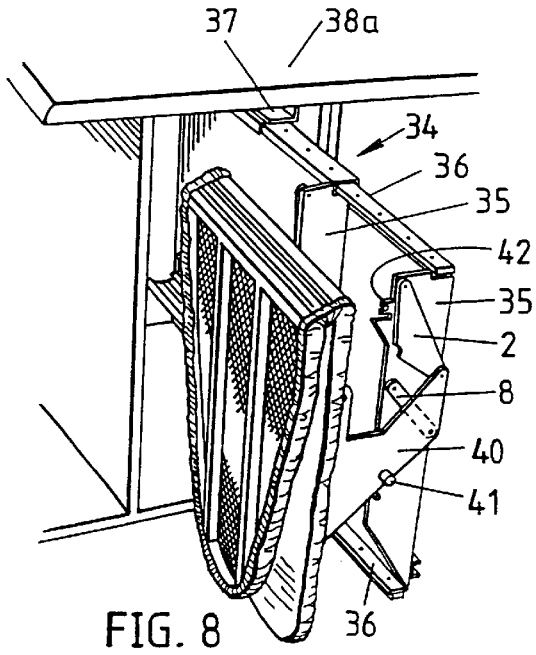
Figure 9:
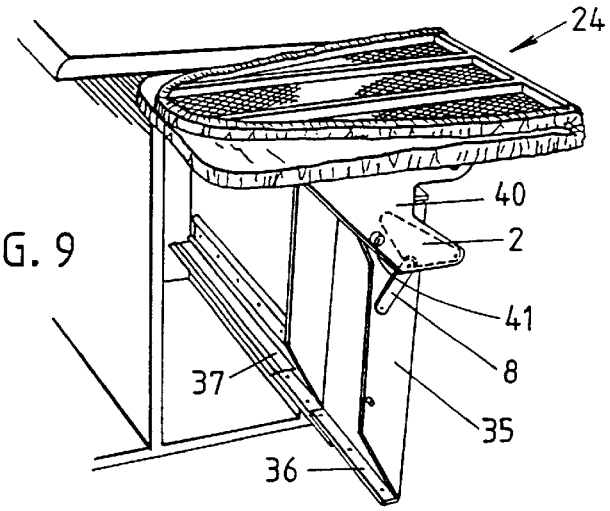
Figure 10:
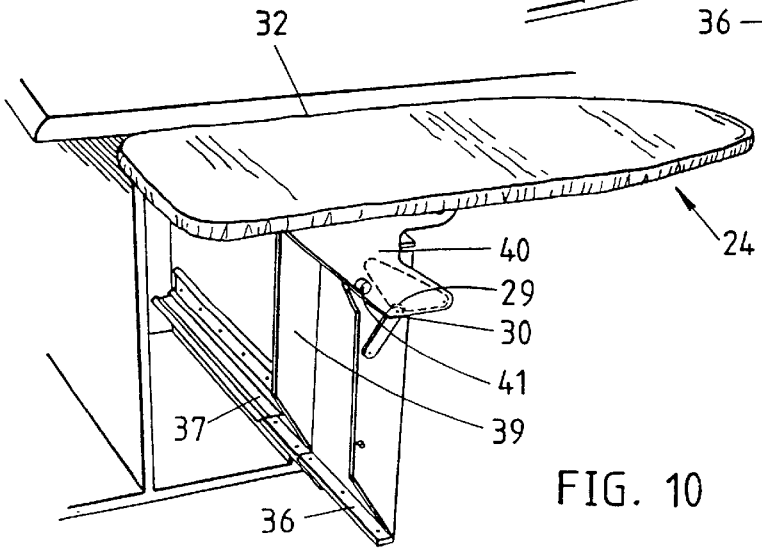

Ironing board member 24 can be mounted to each angularly movable support member 40 such that when in the operative position shown in FIG. 10, longitudinal edge 32 is in close proximity to the support structure upright wall 39 and a portion of support means 34 (i.e. a portion of arms 36) extends between upright wall 39 and longitudinal edge 32. When the board which is shown in FIG. 7 is desired to be used, the foldaway ironing board assembly 32 and the telescopic arms 36 are extended as shown in FIG. 8. Ironing board member 24 is then rotated to through 90° as shown in FIG. 9 in which engagement means 29, 30 move from a disengaged relationship to an engaging relationship. Locking pin 41 may then be screwed into aperture 42 to provide a positive locking of ironing board assembly 32. The ironing board member 24 can be unfolded ready for use. When it is no longer required to be used assembly 33 can be stored by a reverse operation to that as described.

Figure 11:
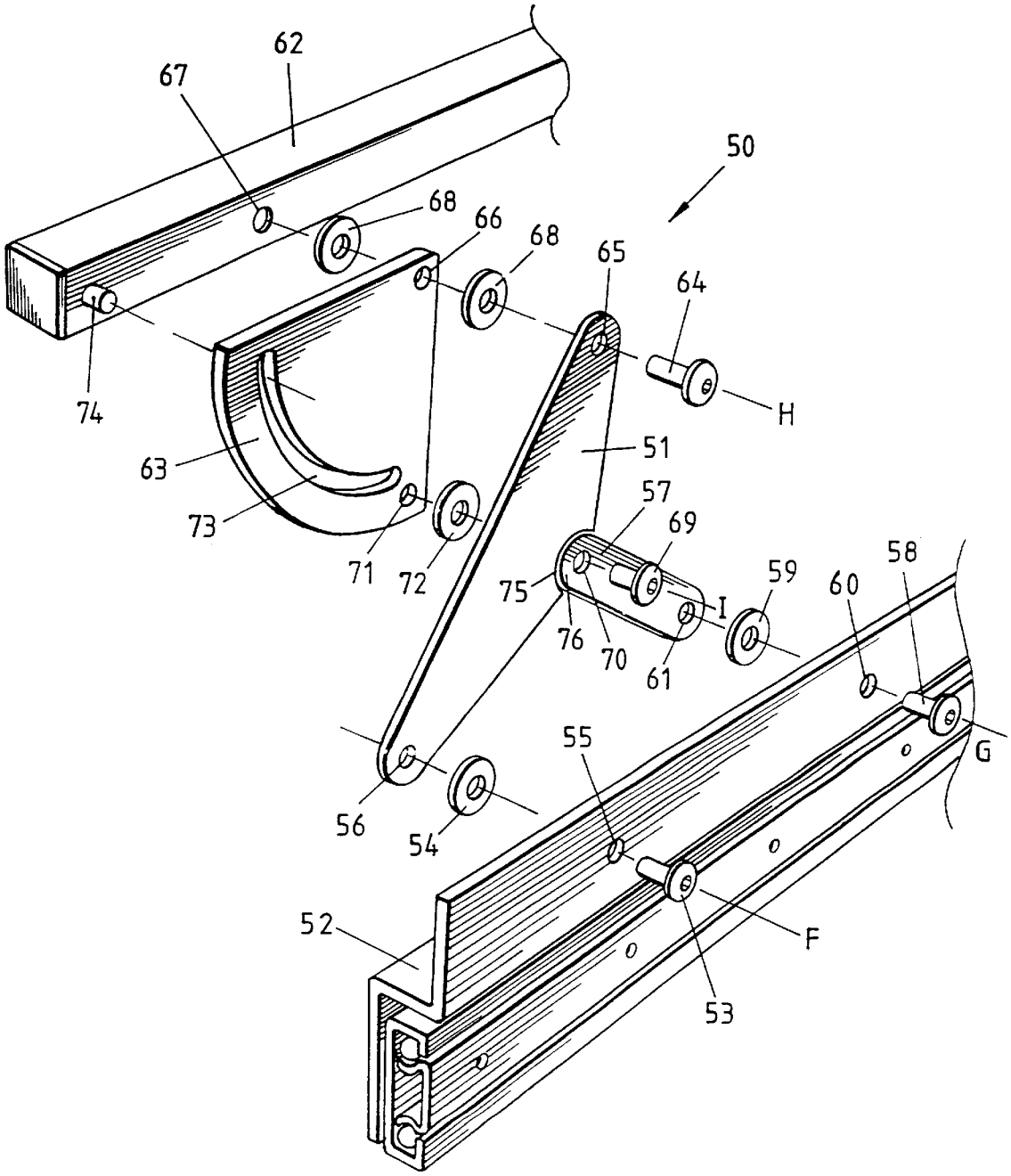
FIG. 11 is an exploded perspective view of another preferred embodiment of a support means.

Referring to FIG. 11, there is illustrated a further embodiment of a support means 50 which can include a first support member 51, second support member 57, third support member 62, fourth support member 63 and a retractable telescopic arm 52.

First support member 51 is preferably pivotally mounted to retractable telescopic arm 52 about a first horizontal pivotal axis F. Pivot pin 53 inserted through apertures 55, 56 and washer 54 provides the pivotal mounting about horizontal axis F. Second support member 57 can be pivotally mounted to arm 52 about a second horizontal axis G. Pivot pin 58, inserted through apertures 60, 61 and washer 59 provide the pivotal mounting about horizontal axis G. First, third and fourth support members 51, 62, 63 are ideally pivotally mounted about a common horizontal axis H by pivot pin 64 inserted through apertures 65, 66, 67 and washers 68. Further, fourth support member 63 is ideally pivotally mounted to second support member 57 about a horizontal axis I by pivot pin 69 inserted through apertures 70, 71 and washer 72. When pivot pins 53, 58, 63, 69 have been inserted as described, they may be fixed against being removed when their ends are peened.

Fourth support member 63 has an arcuate slot 73 which can receive a pin 74 protruding from third support member 62. Furthermore first support member 51 can have a female engagement means 75 for engagement with a male engagement means 76 located at one end of second support member 57.

Figure 12:
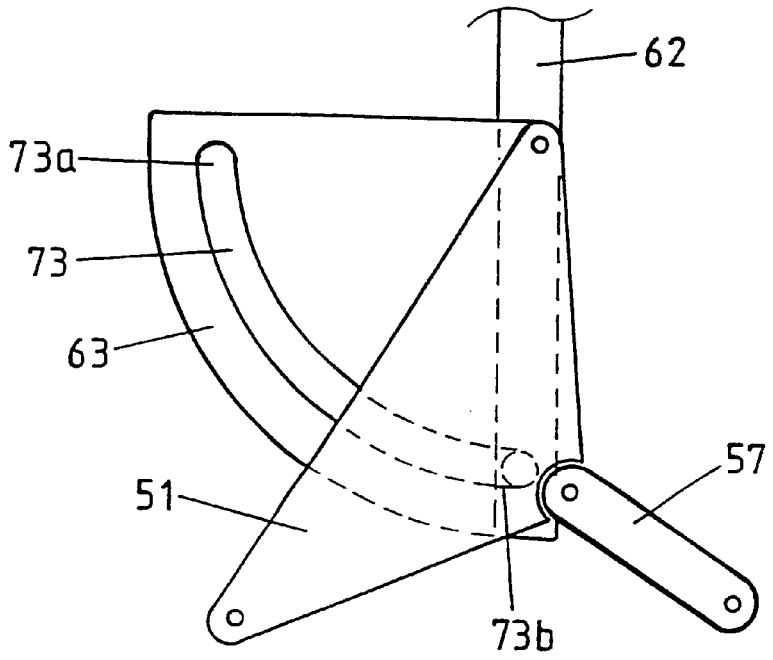
FIGS. 12 and 13 are side views of the support means of FIG. 11 when rotated from the position of FIG. 11 through 90° and 180° respectively.
Figure 13:
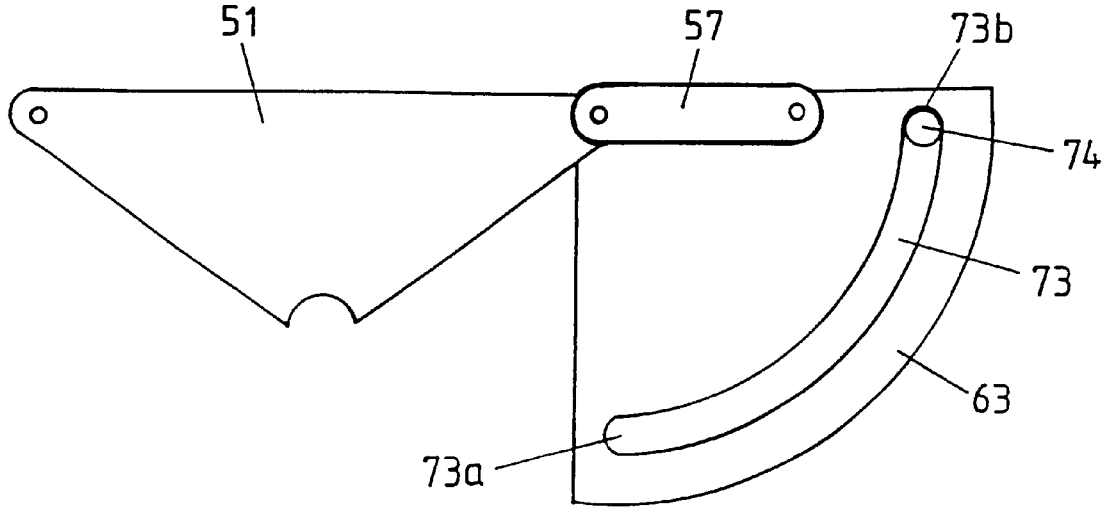
Figure 14:
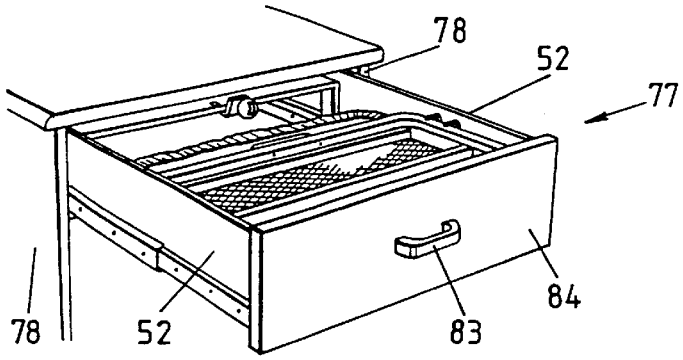
FIGS. 14 to 18 are perspective views of a third embodiment of the invention including the support means of FIGS. 11 to 13.

FIG. 11 shows the assembly in an operative position in which pin 74 limits movement of third support member 62 by abutting end of arcuate track 73. Referring to FIG. 12, third support member has been rotated through 90° and therefore pin 74 has moved along arcuate track 73 to its end 73*b*. Accordingly, further rotation of third support member dis-engages engagement means 75, 76 as shown in FIG. 13 which thereby allows third support member to be rotated through another 90° resulting in 180° rotation in total.

Referring to FIGS. 14 to 18, there is illustrated a further embodiment of a foldaway ironing board assembly 77 which can be supported from a support structure such as supporting walls 78 of a sliding drawer assembly. Two retractable telescopic arms 52 of a respective cantilevered support means 50 are ideally slidably mounted to runners associated with a respective upright supporting wall 78.

Figure 15:
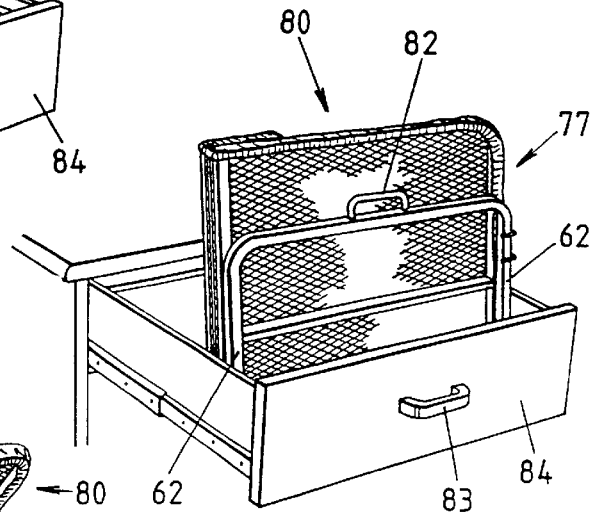
Figure 16:
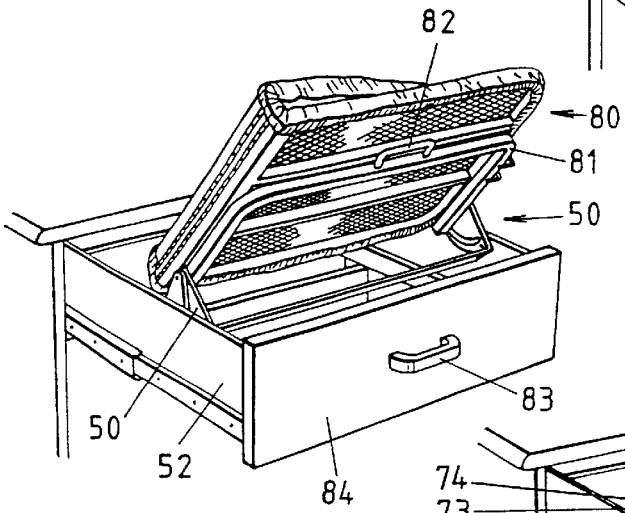
Figure 17:
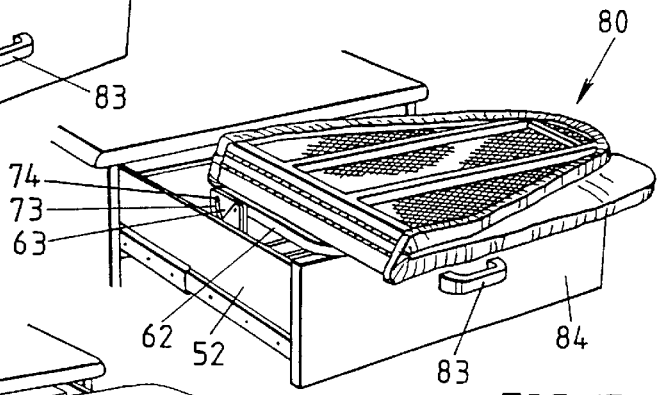
Figure 18:
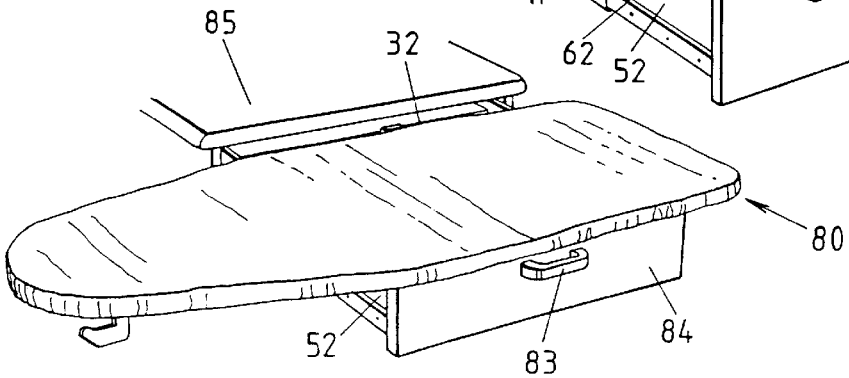

Foldaway ironing board assembly 77 can include an ironing board member 80 identical to that of FIGS. 3 to 6 and therefore to avoid repetition is not described again. Ironing board member 80 can be mounted to a bent tubular bar 81 with a handle 82 mounted thereto. Tubular bar 81 can be used to provide two third support members 62. Accordingly, foldaway ironing board assembly 77 has two support means 50 as described in FIGS. 11 to 13. When foldaway ironing board assembly 77 is desired to be used a handle 83 mounted to front drawer wall 84 which is mounted to ends of telescopic arms 52 is used to pull arms 52 to the extended position shown in FIG. 14 when in this position each of support means 50 is in the position shown in FIG. 13. Handle 82 may then be used to rotate board member through 180° as shown in FIGS. 15, 16 and 17 in which 90° corresponds to the position shown in FIG. 12. Due to the arrangement of support means 50, lifting of board member 80 causes it to be raised to clear drawer wall 84. After board member 80 has been pivoted through 180° it is unfolded into an operative position ready for use as illustrated in FIG. 18. When in this position a longitudinal edge 32 is in close proximity of support structure 85. When it is no longer required to be used, assembly 77 can be stored by a reverse operation to that as described.

Figure 19:
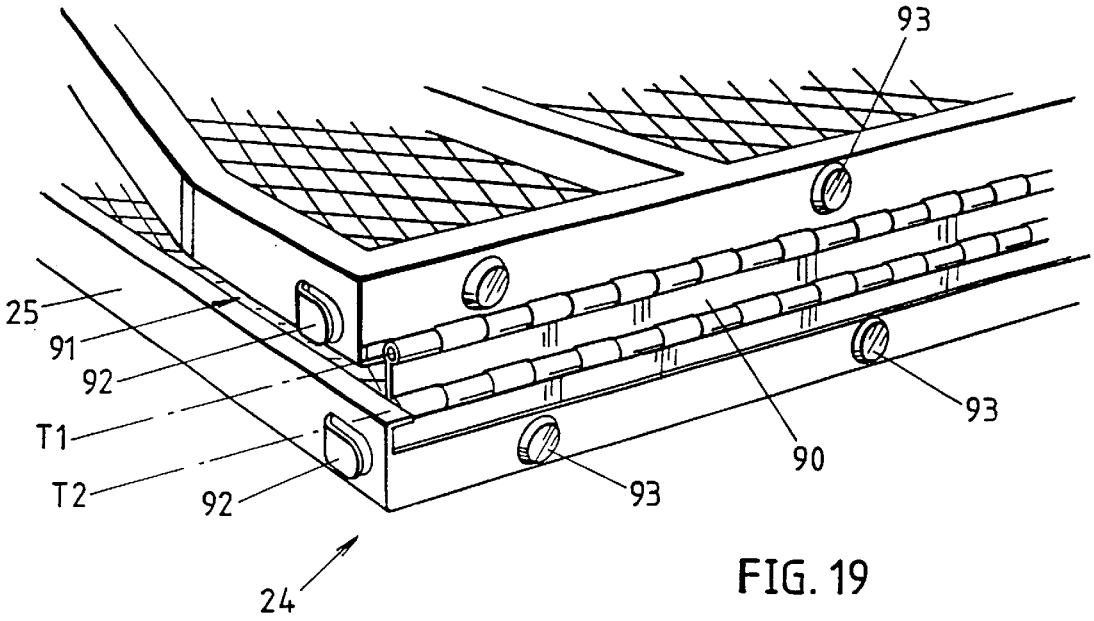
FIG. 19 is a perspective view of a hinge used to fold an ironing board member as used in the invention.

Referring to FIG. 19, a double hinge 90 is illustrated which can be mounted to board member 24 to provide pivotal movement about adjacent transverse axes T1 and T2. This therefore allows a space 91 to accommodate a cushioned cover 28 (not shown in FIG. 19) when sandwiched by board member 24 when in the folded position as shown. Further, there are tabs 92 protruding from frame 25 for engaging and holding cushioned cover 28 and protrusions 93 ensure a planar ironing surface is provided when board member 24 is unfolded to the operative position.

Figure 20:
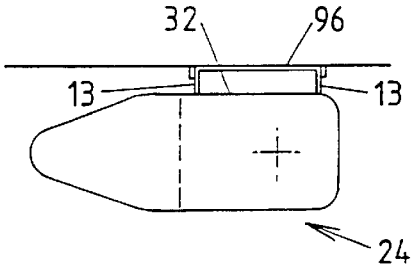
FIGS. 20 to 22 illustrates a pivot means which can be used in the invention.
Figure 21:
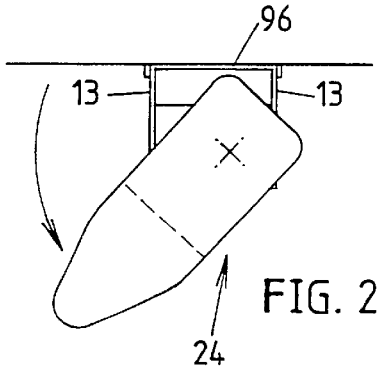
Figure 22:
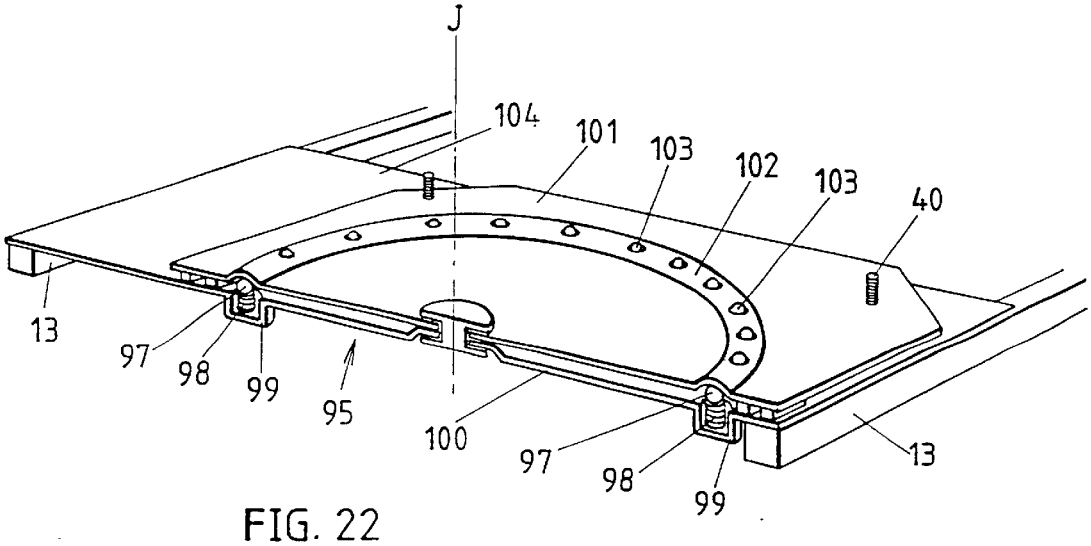

Referring to FIGS. 20 to 22, there is illustrated a pivot means 95 for selectively allowing limited rotation of board member 24 about a vertical axis J. Therefore board member 24 can be selectively rotated as illustrated by the arcuate arrowed line to positions other than edge 32 being parallel to support structure 96 The pivot means as includes ball bearings 97 biassed by springs 98 mounted in an arcuate track 99 which is part of a base plate 100 mounted to, for example, the links of the above described mounting mechanism. Pivotally attached about vertical axis J is a rotatable plate 101 with an arcuate track 102 having apertures 103 therein for engagement with ball bearings 97. Bolts 104 allow for mounting of ironing board member 24 (of FIG. 19) to rotatable plate 101 and selective positioning about vertical axis J of board member 24 is provided by rotation of plate 101 relative to base plate 100. During this rotation ball bearings 97 engage apertures 103 to restrict pivotal movement when a desired position has been obtained.

Figure 23:
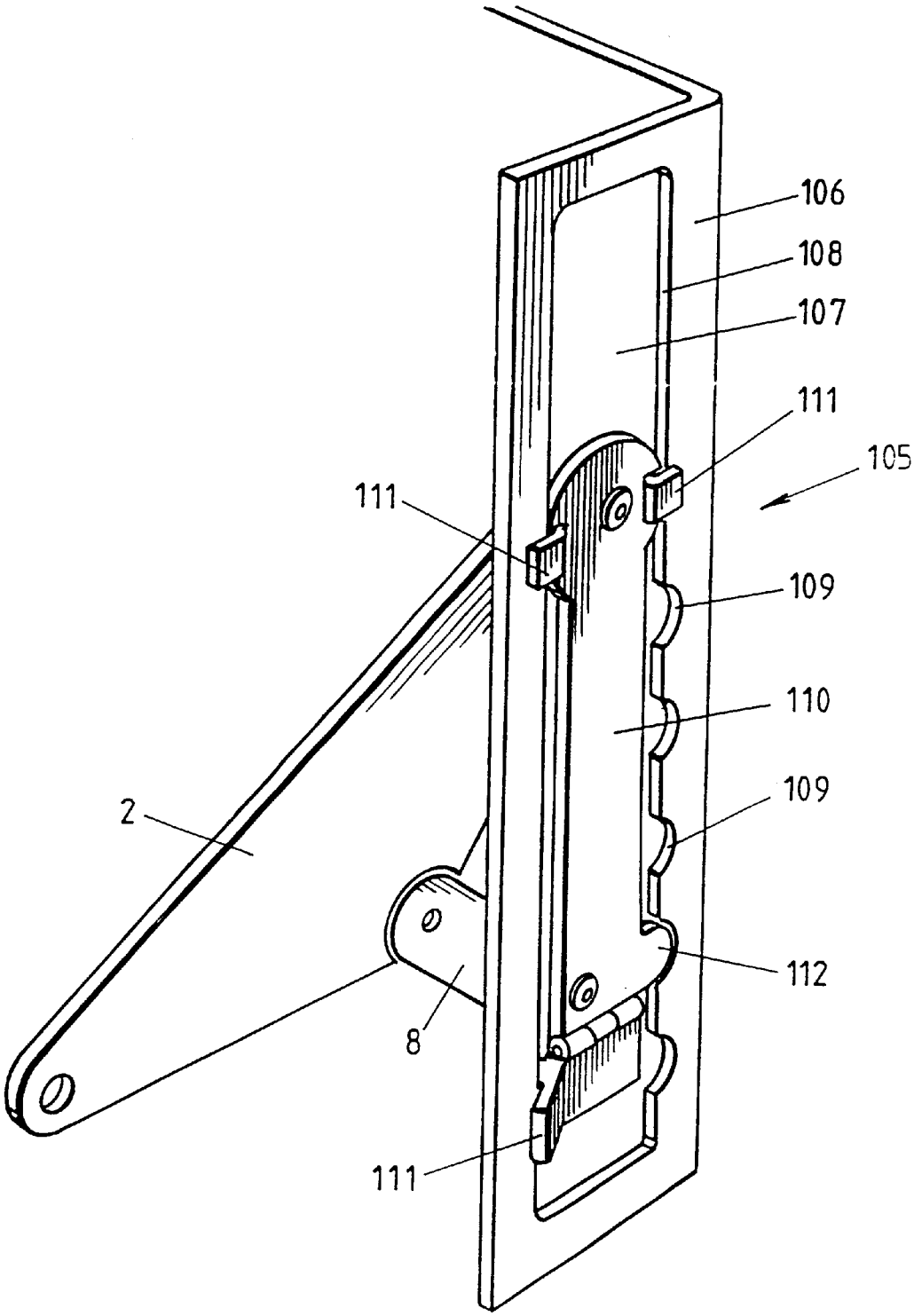
FIG. 23 illustrates a perspective view of a height adjustment means.

Referring to FIG. 23, there is illustrated a height adjustment means 105 comprising a mounting plate 106 with a slot 107 punched therein. Along one longitudinal edge of slot 107 are a plurality of female engagement means in the form of recesses 109.

Height adjustment means 105 can also include a moveable plate 110 which is held captive in slot 107 by tabs 111. At a lower end of plate 110 is a male engagement means in the form of protrusion 112 for engaging with one of recesses 109. Height adjustment means 105 can replace, for example, plate 3 as described in FIG. 1. Accordingly, first support member 2 and second support member 8 are pivotally mounted to plate 110 and height adjustment is effected by selective engagement of protrusion 112 with one of recesses 109. Once engaged the weight of ironing board member 24 assists in maintaining engagement of protrusion 112 in one of recesses 109.

Figure 24:
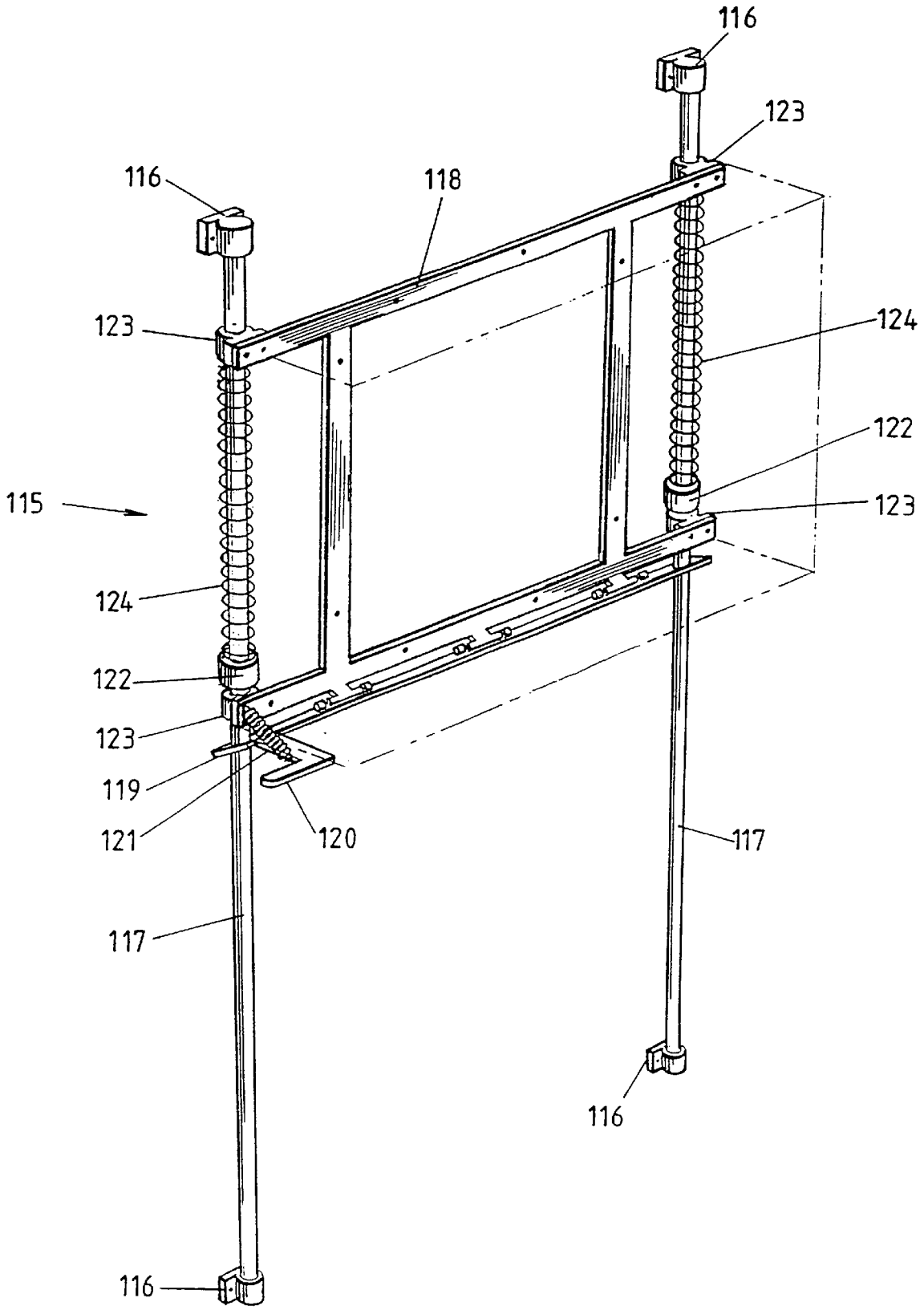
FIG. 24 is a perspective view of an adjustable mount.

Referring to FIG. 24, there is illustrated an adjustable mount 115 for the foldaway ironing board assembly 23 illustrated in FIGS. 3 to 6. Mount 115 includes wall mounting means in the form of two pairs of spaced apertured plates 116 and two parallel upright tracks 117 each being mounted at its ends to one of plates 116. Mount 115 also includes an ironing board mounting means in the form of an apertured frame 118 slidably mounted to tracks 117. To selectively limit movement of frame 118 relative to tracks 117 a lock 119 is pivotally mounted to frame 118. Lock 119 has a handle 120 biased by spring 121 to a locked position in which lock 119 grips tracks 117. To release frame 118 from the locked position handle 120 is pushed downwards and allows frame 118 to slide along tracks 117 to provide height adjustment of foldaway ironing board assembly 23 when mounted to frame 118. Collars 122 are fixed to respective tracks 117 and between an upper slidable frame mount 123 and a respective collar 122 there is mounted a spring 124 for biasing frame 118 to upper ends of tracks 117. In use, mount 115 allows height adjustment of a mounted foldaway ironing board assembly 23 which is beneficial for a household of people with different heights in which one or more of the people may be confined to a wheelchair.

Although the invention has been described with reference to preferred embodiments it is to be understood that the invention is not limited to the specific embodiments described herein.

What is claimed is:

1. An ironing board, comprising:

a planar element adapted to provide an ironing surface;

mounting means by which the planar element is able to be pivotally moved from a storage position to a working position;

said mounting means comprising a pair of spaced apart pivotal linkages, each said pair having first and second links, each of said first and second links being connected at respective spaced apart first ends to a support and respective spaced apart second ends to the planar element;

at least one of said first and second links comprising stop means mounted to the first linkage, said stop means engaging at the working position with that end of the second linkage which attaches to the ironing surface, said engagement involving a convex surface nested in a complementary concavity on the respective engaging parts, said stop means restricting angular movement of the ironing surface past the working position.

2. An ironing board as claimed in claim 1 wherein the storage position is vertically in a wall mounted cabinet having a back, the first and second linkages extend from the back of the cabinet standing the planar element thereof; the first or second linkages enabling angular movement to a generally horizontal working disposition projected forwardly of the cabinet.

3. A wing with an edge and a first end and a second end, said wing comprising at the first end a first mounting assembly and at said second end a second mounting assembly, whereby said wing pivots about an axis generally parallel with said edge, the first and second mounting assemblies comprising:

a first link, wherein a first end of said first link is pivotally mounted to a support, and wherein a second end of said first link is pivotally mounted to said to said wing distal to an end of the wing;

a second link, wherein a first end of said second link is pivotally mounted to the support, and wherein a second end of said second link is pivotally mounted to said wing proximate an end of said member;

wherein at least one of said first and second links comprises stop means for restricting angular movement of the member past the working position.

4. A hinge for connecting an ironing board to a wall, comprising:

a) a bracket;

b) a moveable member;

c) a first link having a first end and a second end, said first link pivotally connected to said bracket at said first end of said first link and pivotally connected to said moveable member at said second end of said first link, where said first link includes a concave void formed in an edge;

d) a second link having a first end and a second end, said second link pivotally connected to said bracket at said first end of said second link and pivotally connected to said moveable member at said second end of said second link, where said second link includes a convex shape;

e) wherein the hinge operates in such a manner that as the ironing board rotates from its storage position against the wall to its operating, generally horizontal, position said first link rotates about a pivot point in its first end and said second link rotates about a pivot point in its first end until said concave void encases the convex shape.

5. The hinge of claim 4 wherein said first link is triangular shaped having first, second-and third corners, said first and second link ends being at first and second corners of the triangle, and said concave void is formed in the third triangle corner.

6. The hinge of claim 4 wherein the moveable member has a first end proximate the bracket when the ironing board is in its operating position, and said second link is pivotally connected to said moveable member proximate said first end of the moveable member, and said first link is pivotally connected to said moveable member distal said first end of the moveable member.

7. The hinge of claim 4 wherein the first link is pivotally connected to said bracket in a position vertically higher than the pivotally connected position of the second link to the bracket.

8. The hinge of claim 4 wherein the concave void is at a first distance from the wall when the ironing board is in its storage position, and the concave void is at a second distance from the wall, greater than the first distance, when the ironing board is in its operating position.

9. The hinge of claim 4 wherein the second end of said second link includes said convex shape.

10. A hinge for connecting an ironing board to a wall, comprising:

a) a bracket;

b) a moveable member;

c) a first link having a first end and a second end, said first link pivotally connected to said bracket at said first end of said first link and pivotally connected to said moveable member at said second end of said first link;

d) a second link having a first end and a second end, said second link pivotally connected to said bracket at said first end of said second link and pivotally connected to said moveable member at said second end of said second link;

e) stop means for supporting the ironing board in an operating, generally horizontal, position, said stop means including an engagement member located on said second link with a support pocket on said first link, where the engagement member is secured by the support pocket at a second distance away from the wall which is greater than a first distance at which the support pocket and the engagement member are located when the ironing board is in a stored position against the wall, whereby the ironing board is located away from the wall when it is in its operating position.

11. The hinge of claim 10 wherein said first link is triangular shaped having first, second and third corners, said first and second link ends being at first and second corners of the triangle, and said concave void is formed in the third triangle corner.

12. The hinge of claim 10 wherein the moveable member has a first end proximate the bracket when the ironing board is in its operating position, and said second link is pivotally connected to said moveable member proximate said first end of the moveable member, and said first link is pivotally connected to said moveable member distal said first end of the moveable member.

13. The hinge of claim 10 wherein the first link is pivotally connected to said bracket in a position vertically higher than the pivotally connected position of the second link to the bracket.

14. The hinge of claim 10 wherein the support pocket is at a first distance from the wall when the ironing board is in its storage position, and the support pocket is at a second distance from the wall, greater than the first distance, when the ironing board is in its operating position.

15. The hinge of claim 10 wherein the second end of said second link includes said engagement member.

* * * * *